US006193857B1

(12) United States Patent
Davison et al.

(10) Patent No.: US 6,193,857 B1
(45) Date of Patent: Feb. 27, 2001

(54) CONNECTOR FOR USE IN CATHODIC PROTECTION AND METHOD OF USE

(75) Inventors: Nigel Davison, Derbyshire; Christopher D. Gorrill, Warwickshire, both of (GB)

(73) Assignee: Foseco International Limited, Wiltshire (GB)

( * ) Notice: Subject to any disclaimer, the term of this patent is extended or adjusted under 35 U.S.C. 154(b) by 0 days.

(21) Appl. No.: 09/306,419

(22) Filed: May 6, 1999

(51) Int. Cl.[7] ..... C23F 13/00

(52) U.S. Cl. ..... 204/196.01; 204/196.2; 204/196.22; 204/196.25; 204/196.33; 205/734; 264/239; 264/299; 264/DIG. 63

(58) Field of Search ..... 204/196.01, 196.2, 204/196.33, 196.34, 196.25, 196.22; 205/734; 264/239, 299, DIG. 63

(56) References Cited

U.S. PATENT DOCUMENTS 5,609,748 3/1997 Kotowski ..... 205/734
5,639,358 * 6/1997 Bennett et al. ..... 204/196.33
6,022,469 * 2/2000 Page ..... 204/195.25

FOREIGN PATENT DOCUMENTS 3434222 3/1986 (DE) .

* cited by examiner

*Primary Examiner*—Bruce F. Bell
(74) *Attorney, Agent, or Firm*—Nixon & Vanderhye P.C.

(57) ABSTRACT

Cathodic protection of concrete-reinforcing steel reinforcing elements is accomplished utilizing an anode of a metal (e.g. zinc) having a more negative electrical potential than the steel reinforcing element, and connecting at least one wire made of a ductile metal to the anode. The anode may be cast around the wire, or a twisted portion of two or more wires. The wires are wrapped around one or more of the reinforcing elements and electrically and physically connect the anode to the reinforcing elements. The cathodic protection is maintained over a sustained period of time by casting a cementitious material around the anode, e.g. a mortar containing an electrolyte solution having a pH of at least about 14 when the anode is zinc.

18 Claims, 3 Drawing Sheets

CONNECTOR FOR USE IN CATHODIC PROTECTION AND METHOD OF USE

FIELD OF THE INVENTION

This invention relates to the cathodic protection of steel in reinforced concrete employing a sacrificial anode, more particularly to an electrical connector for connecting the sacrificial anode to the reinforcing steel it is intended to protect and to a method for the installation of the anode.

BACKGROUND OF THE INVENTION

Sacrificial anodes are well known. To be effective the sacrificial anode is made of a metal which has a more negative electrode potential than the steel to be protected so that it will corrode in preference to the steel. Sacrificial anodes are described in European Patent No 0707667 and U.S. Pat. No. 5,292,411.

PROBLEM TO BE SOLVED BY THE INVENTION

To fulfill its purpose the sacrificial anode needs to be connected electrically to the steel to be protected. Metal conductors have been previously used for this purpose. Previously these metal conductors such as wires, have been attached to the steel reinforcement by drilling a hole in the reinforcement into which a self tapping screw is inserted. Alternative methods have involved the use of clips or clamps to secure the wire to the metal to be protected.

These methods have problems in that the drilling of holes and use of self tapping screws is time consuming and there is always a risk that the clips and clamps may be dislodged.

The present invention provides a solution to these problems by the use of a ductile elongated connector that is connected to the steel reinforcing element by winding the connector around the reinforcing element.

SUMMARY OF THE INVENTION

According to the present invention there is provided an assembly (and a method of utilization thereof for use in the cathodic protection of steel reinforcement in reinforced concrete. The assembly comprises: (i) An anode of a metal having a more negative electrode potential than steel (and adapted to be in electrical contact therewith); and (ii) An elongated electrical connector made of a ductile metal capable of being wound around a concrete reinforcing steel reinforcing element to be protected.

The elongated connector of the assembly may be in the form of at least one wire, and the anode may be in the form of a block cast around a portion of the length of the wire. For example the elongated connector may comprise a plurality of wires twisted together over a portion of their length, and the anode formed (e.g. cast) around the twisted portion. Preferably the wires are twisted together at a position intermediate their ends so that the wires extend outwardly from more than one side of the anode. The anode may be enclosed in a porous material which has been cast around it, the porous material containing an electrolytic solution whose pH is sufficiently high for corrosion of the anode to occur and passive film formation on the anode to be avoided when the anode is galvanically connected to a concrete steel reinforcement.

The invention also preferably comprises an assembly as described above in combination with a concrete steel reinforcing element, the assembly being connected to the reinforcing element (both physically and electrically) by winding the elongated connector around the reinforcing element.

According to another aspect of the present invention there is provided at least first and second wires twisted together at a position intermediate their ends to form a twisted portion. A block of anode material cast around the twisted portion, so that at least four wire arms extend outwardly from the block. And, wherein the wires are of ductile metal capable of wrapping around a concrete reinforcing steel reinforcing element. A cementitious material may also be cast around the anode, as described earlier.

According to another aspect of the present invention there is provided a method of making an assembly for use in the cathodic protection of steel reinforcement in reinforced concrete using an anode of a metal having a more negative electrode potential than steel, and an elongated electrical connector made of a ductile metal capable of being wound around a steel reinforcing element to be protected. The method comprises: (a) Melting the metal for the anode, so that it is in liquid form. (b) Placing a part of the length of the connector in a mold. And, (c) casting the anode from the liquid metal in the mold to form a block of metal around a portion of the length of the elongated electrical connector.

The method may further comprise (d) producing a liquid or semi-liquid mixture of a porous material containing an electrolytic solution having a pH sufficiently high for corrosion of the anode to occur and passive film formation on the anode to be avoided when connected to a steel reinforcement, and (e) forming a solid block of the mixture around the anode from (c).

According to yet another aspect of the invention there is provided a method of installing a sacrificial anode to protect the steel reinforcement of reinforced concrete which method comprises in any order: (a) Making an electrical connection between the sacrificial anode and an elongated connector made of a ductile metal capable of being wound around the reinforcement. And, (b) making electrical contact between the elongated connector and the steel reinforcement by winding the elongated connector around the steel reinforcement. In the method (a) may be practiced by casting the anode from a liquid metal in a mold containing part of the connector, to form a block of metal around a portion of the length of the elongated connector. The method may further comprise (carried out before or after (b)) (c) casting around the anode a porous material containing an electrolyte solution having a pH sufficiently high for corrosion of the anode to occur and passive film formation to be avoided. In the method (a) through (c) may be practiced using a zinc anode, and using an electrolyte solution having a pH of at least about 14. The method may also further comprise, after (b), tightening the elongated connector around the reinforcement by twisting the ends of the elongated connector together (e.g. using a ratchet twisting tool).

It is the primary object of the present invention to provide an advantageous assembly and method for cathodic protection of steel and reinforced concrete. This and other objects of the invention will become clear from an inspection of the detailed description of the invention and from the appended claims.

ADVANTAGEOUS EFFECT OF THE INVENTION

The connector can be installed in less time than the previously used methods involving the use of self tapping screws and is more secure than the clips or clamps.

DETAILED DESCRIPTION OF THE DRAWINGS

Figure 1:
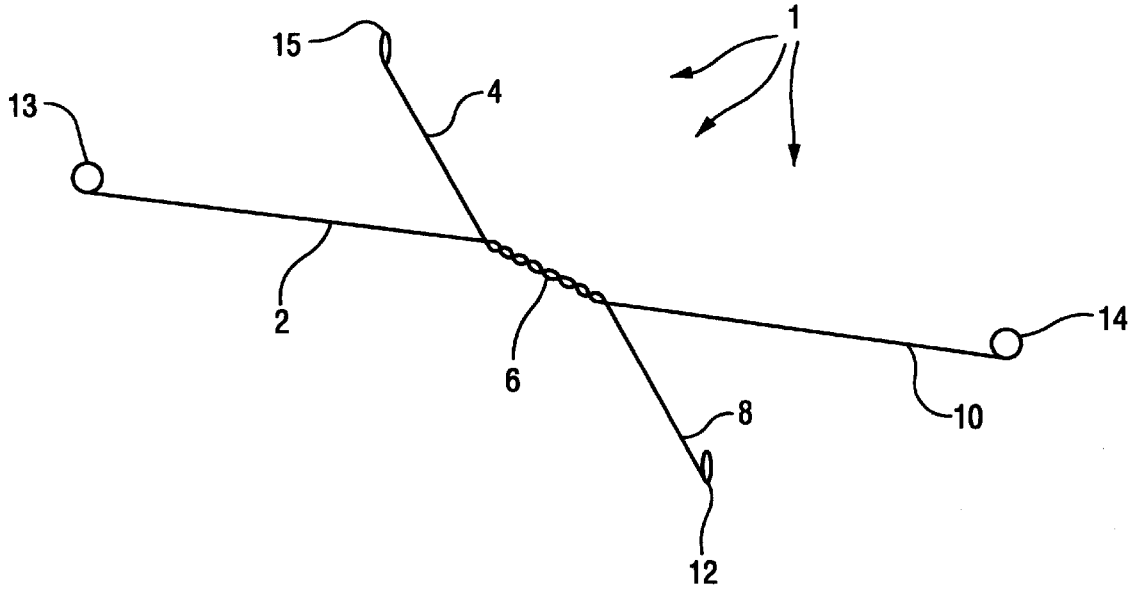
FIG. 1 is a perspective view of one embodiment of the invention in which two wires are twisted together.

The anode 20 used in the practice of the invention is preferably zinc but aluminium, cadmium or magnesium may be used. References to these metals include alloys containing them.

The electrical contact between the connector 1 and the anode 20 is preferably provided by having the anode 20 in the form of a block which has been cast (by cast is meant allowing the liquid metal to solidify to form the block) around a portion of the length of the elongated connector 1. Alternatively the electrical contact may provided by the elongated connector being wound around the anode 20 or by the connector 1 being soldered or similarly attached to the anode 20.

The elongated connector 1 is conveniently in the form of one or more ductile wires, although other elongated forms may be used. The wire(s) may conveniently be of steel, preferably a mild steel. Preferably the wire(s) of connector 1 is as noble or more noble than the steel of the reinforcement 30 in the concrete 31.

The connector 1 may comprise a plurality of wires twisted together over a portion of their length and the anode may be cast around the twisted portion. The word "twisted" includes folded, bent, and/or crimped. The purpose of the twisted portion is to increase the surface area of the wire forming the interface with the cast anode 20 and thereby improve the electrical contact. The wires may be twisted together at a position which is intermediate their ends (for example near the middle of their lengths) so that lengths of wire 2, 4, 8, 10 extend on both sides of the cast anode 20.

Patent Application No WO 94/29496 (European Patent Application No 0707667) describes a method of cathodic protection in which to maintain the cathodic protection over a sustained period of time the anode is surrounded by a material containing an electrolyte of high pH. To avoid passivation of the anode it recommends that in the case of a zinc anode the pH is at least about 14. Suitable materials described in this reference are cementitious mortars which may be cast around the anode to form a unit. It is not essential that the mortar is cementitious although such mortars are more readily available. The mortar may be prepared from a cement that has an intrinsically high alkali content or additional alkali may be added to the mortar, e.g. sodium hydroxide or lithium hydroxide, the latter being preferred.

The assembly of anode and connector of the present invention may have a porous material, e.g. a cementitious mortar, cast around the anode. "Cast" means forming a solid block from liquid or semi-liquid mortar. The casting is preferably carried out in a mold. The porous material is one that preferably contains a high pH electrolyte as described in European Patent Application No. 0707667, i.e. one containing an electrolyte solution whose pH is sufficiently high to maintain corrosion of the anode and passive film formation on the anode to be avoided when the anode is galvanically connected to the steel reinforcement. In the case of a cementitious mortar the electrolyte solution is the pore solution.

The mortar will preferably have a content of alkali equivalent to at least 1% lithium hydroxide based on the dry weight of the ingredients used to make the mortar. An equivalent amount of sodium hydroxide is at least 2% by weight. Conveniently the amount of lithium hydroxide is greater than 2% or an equivalent amount of sodium hydroxide of greater than 4%. Lithium hydroxide is the preferred alkali because lithium ions provide protection against alkali silica (or alkali aggregate) reactions in concrete. However mixtures of alkalis may be used, for example mixtures of lithium hydroxide and sodium hydroxide.

The anode, the porous material (e.g. mortar), and the casting may also be as described in European Patent Application No 0707667.

Figure 4:
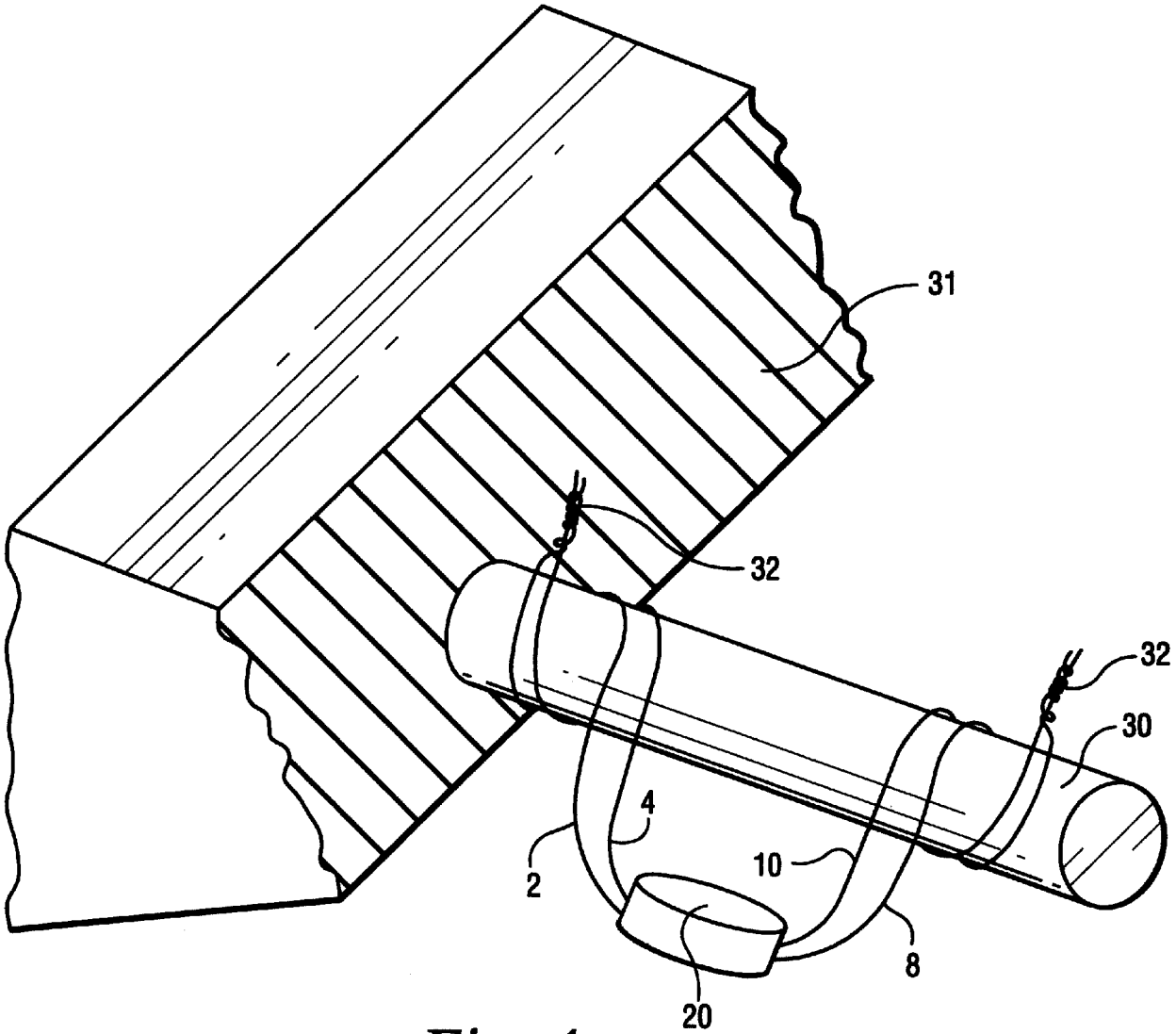
FIG. 4 is a perspective schematic view showing the assembly of FIG. 2 wrapped around a steel reinforcement in concrete.

According to another aspect of the present invention there is provided a method of installing a sacrificial anode 20 to protect the reinforcement 30 (FIG. 4) of reinforced concrete 31 which method comprises, in any order: (a) Making an electrical connection between an elongated electrical connector and the anode 20; and (b) Making electrical contact with the steel reinforcement 30 by winding the elongated connector 1 around the steel reinforcement 30. In the method (a) may comprise casting the anode 20 around a portion of the length of the elongated connector 1.

The method may also include, carried out before or after (b), (c) casting around the anode 20 a porous material containing an electrolyte solution having a pH sufficiently high for corrosion of the anode to occur and passive film formation to be avoided. Preferably the anode 20 is zinc in which case the pH of the electrolyte solution is desirably at least about 14. When the anode 20 is of another metal such as aluminium the pH may be lower, for example at least 13.3 or 13.5. The pH may be determined by measuring the hydroxyl ion concentration and applying the equation $pH=14+\log(OH^-)$ after Sorensen.

The invention is applicable to the construction of new reinforced concrete structures 31 in which the anode assembly 18 is connected to the reinforcement 30 by the connector 1 and a high pH porous material 24 such as a mortar cast around the anode 20.

The invention is also applicable to the protection of existing concrete structures 31 in which method a hole may be made in the concrete and (i) the anode 20 inserted into the hole and (ii) the connector 1 connected to the reinforcement 30 and (iii) the high pH material 24 cast around the anode 20. In this embodiment (i), (ii) and (iii) may be carried out in any order Referring to FIG. 1 of the drawings a connector 1 in the form of two wires each being a 16 SWG (standard wire gauge) mild steel wire are twisted together over part of their length at 6. The length of the twisted portion 6 is typically from about 38 to 42 mm. Four lengths of wire in the form of arms 2, 4, 8 and 10 extend from the twisted portion 6. The length of each of the arms 2, 4, 8 and 10 is typically from about 148 to 152 mm when used with standard rebar, and at the end of each arm are loops 12, 13, 14, and 15. The arms 2, 4, 8 and 10 are each wound around the reinforcement 30 (see FIG. 4). Usually one or two complete winds around the reinforcement is sufficient to make a satisfactory electrical contact. The diameter of the loops 12–15 is typically from about 9 to 11 mm. The purpose of the loops 12–15 is to facilitate the use of a tool of the type used to close paper sacks for potatoes and the like. A suitable tool is a spring loaded ratchet twisting tool known as the Stanley tying tool and is available from Direct Wire Ties Limited, England. Using this tool the arms 2, 4, 8 and 10 which have been wound around the steel reinforcement 30 in reinforced concrete 31 may then be twisted together, as seen schematically at 32 in FIG. 4. This has the effect of tightening the connector 1 around the reinforcement 30.

Figure 2:
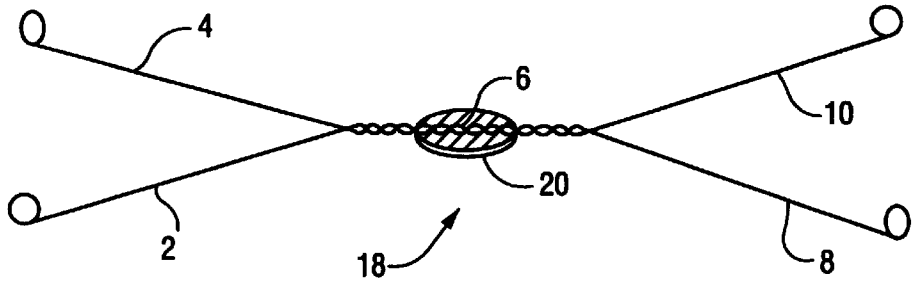
FIG. 2 is a perspective view on a smaller scale than in FIG. 1 in which an anode has been cast around the wires of the connector.

In FIG. 2 a cylindrical zinc block (anode) 20 of about 40 mm diameter and about 7 mm thickness has been cast around the twisted wire portion 6. In FIG. 2 the center of the cylindrical block 20 has been omitted to show the twisted wire portion 6. The top and bottom edges of the block 20 have been rounded to prevent crack inducement.

The assembly shown in FIG. 2 was made by first twisting the wires together near the middle of their length and placing the twisted portion 6 in a ceramic casting mold. Molten zinc was then poured into the mold. After solidifying, the assembly 18 was removed from the mold. The wire arms 2, 4 8, and 10 extend on both sides of the anode 20 and enable the anode 20 to be connected to more than one reinforcing element if desired.

Figure 3:
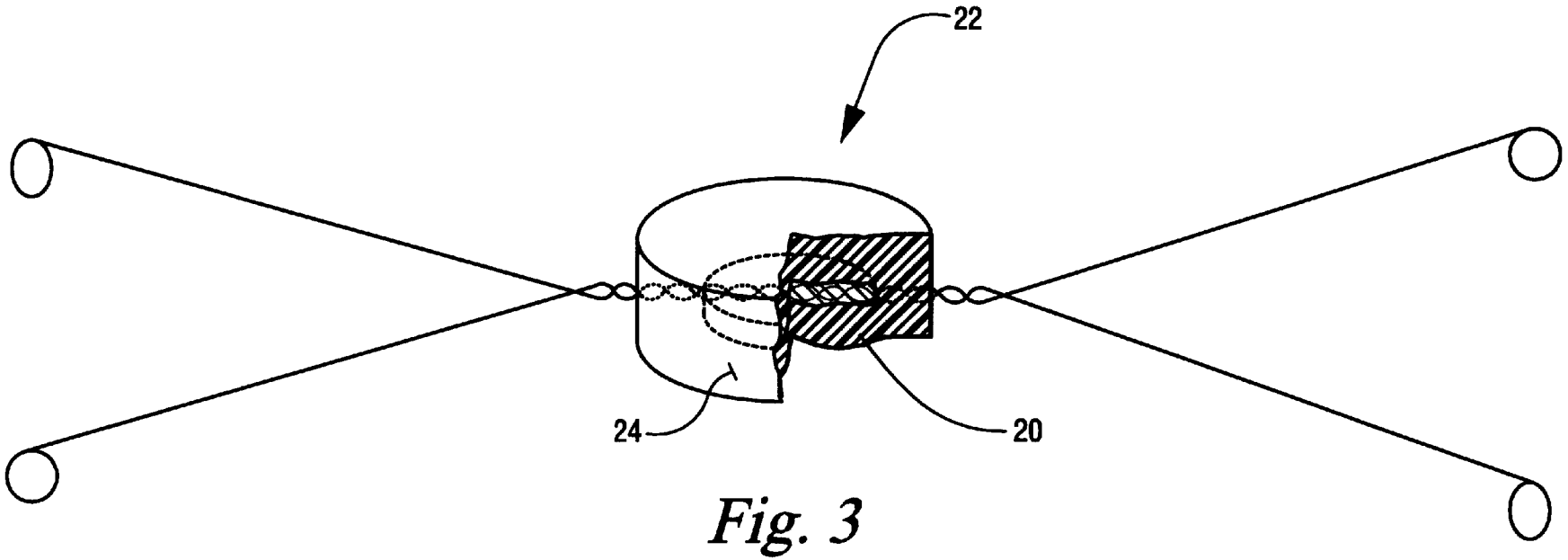
FIG. 3 is a perspective view on the same scale as FIG. 2 of another embodiment in which the anode is surrounded by a mortar which been cast around it.

In FIG. 3 a block of mortar 24 has been cast around the zinc anode 20 shown in FIG. 2 to give a thickness of 10 mm all round the zinc.

The assembly 22 shown in FIG. 3 was made by positioning the assembly 18 shown in FIG. 2 in a previously vacuum formed plastic mold so as to locate the zinc anode 20 centrally in the mold. A high pH cementitious mortar 24 containing a pore solution of pH greater than 14 was prepared by mixing a Portland cement powder (containing 2% by weight of added lithium hydroxide based on the weight of the cement powder) with water and poured into the mold. This was allowed to harden for four hours and then removed from the mold to yield the assembly 22 shown in FIG. 3.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. An assembly for use in the cathodic protection of steel reinforcement in reinforced concrete said assembly comprising:

(i) an anode of a metal having a more negative electrode potential than steel; and (ii) an elongated electrical connector physically and electrically connected to said anode and made of a ductile metal; and wherein said anode is in the form of a block formed around a portion of the length of said elongated connector.

2. An assembly as claimed in claim 1 wherein said elongated connector is in the form of at least one wire.

3. An assembly as claimed in claim 1 wherein said elongated connector comprises a plurality of wires twisted together over a portion of their length, and wherein said anode has been formed around said twisted portion.

4. An assembly as claimed in claim 3 wherein said wires are twisted together at a position intermediate their ends so that said wires extend outwardly from more than one side of said anode.

5. An assembly as claimed in claim 1 wherein said anode is enclosed in a porous material which has been cast around said anode, said porous material containing an electrolyte solution whose pH is sufficiently high for corrosion of said anode to occur and passive film formation on said anode to be avoided when the anode is galvanically connected to a concrete steel reinforcement.

6. An assembly as claimed in claim 5 wherein said anode is made of zinc and said porous material is a cementitious mortar containing an electrolyte solution of pH at least about 14.

7. An assembly as claimed in claim 1 in combination with a concrete steel reinforcing element; and wherein said assembly is connected to said reinforcing element by winding said elongated connector around said reinforcing element.

8. An assembly as claimed in claim 7 wherein said elongated connector comprises at least one wire of a material as noble or more noble than the steel of said steel reinforcing element.

9. An assembly as recited in claim 8 wherein said elongated connector comprises a plurality of wires twisted together over a portion of their length, and wherein said anode has been formed around said twisted portion.

10. An assembly as claimed in claim 9 wherein said wires are twisted together at a position intermediate their ends so that said wires extend outwardly from more than one side of said anode.

11. An assembly for use in the cathodic protection of concrete-reinforcing steel reinforcing elements, said assembly comprising:

at least first and second wires twisted together at a position intermediate their ends to form a twisted portion;

a block of anode material cast around said twisted portion, so that at least four wire arms extend outwardly from said block; and wherein said wires are of ductile metal.

12. An assembly as recited in claim 11 wherein said anode is made of zinc, and wherein said wires are mild steel, and wherein said anode is enclosed in a porous cementitious mortar containing an electrolyte solution of a pH at least about 14.

13. A method of making an assembly for use in the cathodic protection of steel reinforcement in reinforced concrete using an anode of a metal having a more negative electrode potential than steel, and an elongated electrical connector made of a ductile metal, said method comprising:

(a) melting the metal for the anode, so that it is in liquid form;

(b) placing a part of the length of the connector in a mold; and (c) casting the anode from the liquid metal in the mold to form a block of metal around a portion of the length of the elongated electrical connector.

14. A method as claimed in claim 13 further comprising (d) producing a liquid or semi-liquid mixture of a porous material containing an electrolyte solution having a pH sufficiently high for corrosion of the anode to occur and passive film formation on the anode to be avoided when connected to a steel reinforcement; and (e) forming a solid block of the mixture around the anode from (c).

15. A method of installing a sacrificial anode to protect the steel reinforcement of reinforced concrete which method comprises in any order:

(a) making an electrical connection between the sacrificial anode and an elongated connector made of a ductile metal;

(b) making electrical contact between the elongated connector and the steel reinforcement by winding the elongated connector around the steel reinforcement; and after (b)

(c) tightening the electrical connector around the reinforcement by twisting the ends of the elongated connector together using a twisting tool.

16. A method as claimed in claim 15 wherein (a) is practiced by casting the anode from a liquid metal in a mold containing part of the connector to form a block of metal around a portion of the length of the elongated connector.

17. A method as claimed in claim 16 further comprising, carried out before or after (b), (c) casting around the anode a porous material containing an electrolyte solution having a pH sufficiently high for corrosion of the anode to occur and passive film formation to be avoided.

18. A method as claimed in claim 17 wherein (a)–(c) are practiced using a zinc anode and using an electrolyte solution having a pH of at least about 14.

* * * * *

UNITED STATES PATENT AND TRADEMARK OFFICE

CERTIFICATE OF CORRECTION

PATENT NO. : 6,193,857 B1
DATED : February 27, 2001
INVENTOR(S) : Davison et al.

It is certified that error appears in the above-identified patent and that said Letters Patent is hereby corrected as shown below:

Title page,
Item [73] change "Foseco International Limited" to -- FOSROC INTERNATIONAL LIMITED --

Signed and Sealed this

Twenty-eighth Day of May, 2002

*Attest:*

*Attesting Officer*

JAMES E. ROGAN
*Director of the United States Patent and Trademark Office*